US006452550B1

(12) United States Patent
Channabasappa et al.

(10) Patent No.: US 6,452,550 B1
(45) Date of Patent: Sep. 17, 2002

(54) REDUCTION OF THE EFFECTS OF PROCESS MISALIGNMENT IN MILLIMETER WAVE ANTENNAS

(75) Inventors: Eswarappa Channabasappa, Nashua, NH (US); Frank Kolak, Billerica, MA (US)

(73) Assignee: Tyco Electronics Corp., Middletown, PA (US)

( * ) Notice: Subject to any disclaimer, the term of this patent is extended or adjusted under 35 U.S.C. 154(b) by 0 days.

(21) Appl. No.: 09/905,244

(22) Filed: Jul. 13, 2001

(51) Int. Cl.[7] ..... H01Q 13/10
(52) U.S. Cl. ..... 343/700 MS; 343/771
(58) Field of Search ..... 343/700 MS, 771, 343/770, 768, 853

(56) References Cited

U.S. PATENT DOCUMENTS 4,864,314 A * 9/1989 Bond ..... 343/700 MS
5,001,492 A * 3/1991 Shapiro et al. ..... 343/700 MS
5,010,351 A 4/1991 Kelly ..... 343/771
5,129,079 A * 7/1992 Miyashita ..... 395/575
5,488,380 A * 1/1996 Harvey et al. ..... 342/368
5,680,139 A * 10/1997 Huguenin et al. ..... 342/175
6,127,901 A 10/2000 Lynch ..... 333/26
6,320,546 B1 * 11/2001 Newton et al. ..... 343/700 MS

* cited by examiner

*Primary Examiner*—Don Wong
*Assistant Examiner*—James Clinger

(57) ABSTRACT

A millimeter wave radar system that is less sensitive to process misalignment. The millimeter wave radar system includes at least one channel formed in a surface of a backing plate; and, a microstrip antenna array assembly including a plurality of conductive microstrips, a ground plane, and a dielectric substrate disposed between the conductive microstrips and the ground plane to form a plurality of microstrip transmission lines. The plate surface is mounted to the ground plate to form at least one waveguide. The ground plane has a plurality of slots formed therethrough to form a plurality of waveguide-to-microstrip transmission line transitions. A portion of the ground plane comprising a wall of the waveguide has a plurality of slots formed therethrough for transferring electromagnetic wave energy between the microstrip transmission lines and the waveguide. The slots are placed on the same side of the longitudinal centerline of the waveguide wall. Conductive microstrips included in the microstrip antenna array are configured to provide sufficient phase shift to assure that the electromagnetic wave energies transferred to the microstrip antenna array are in-phase.

13 Claims, 4 Drawing Sheets

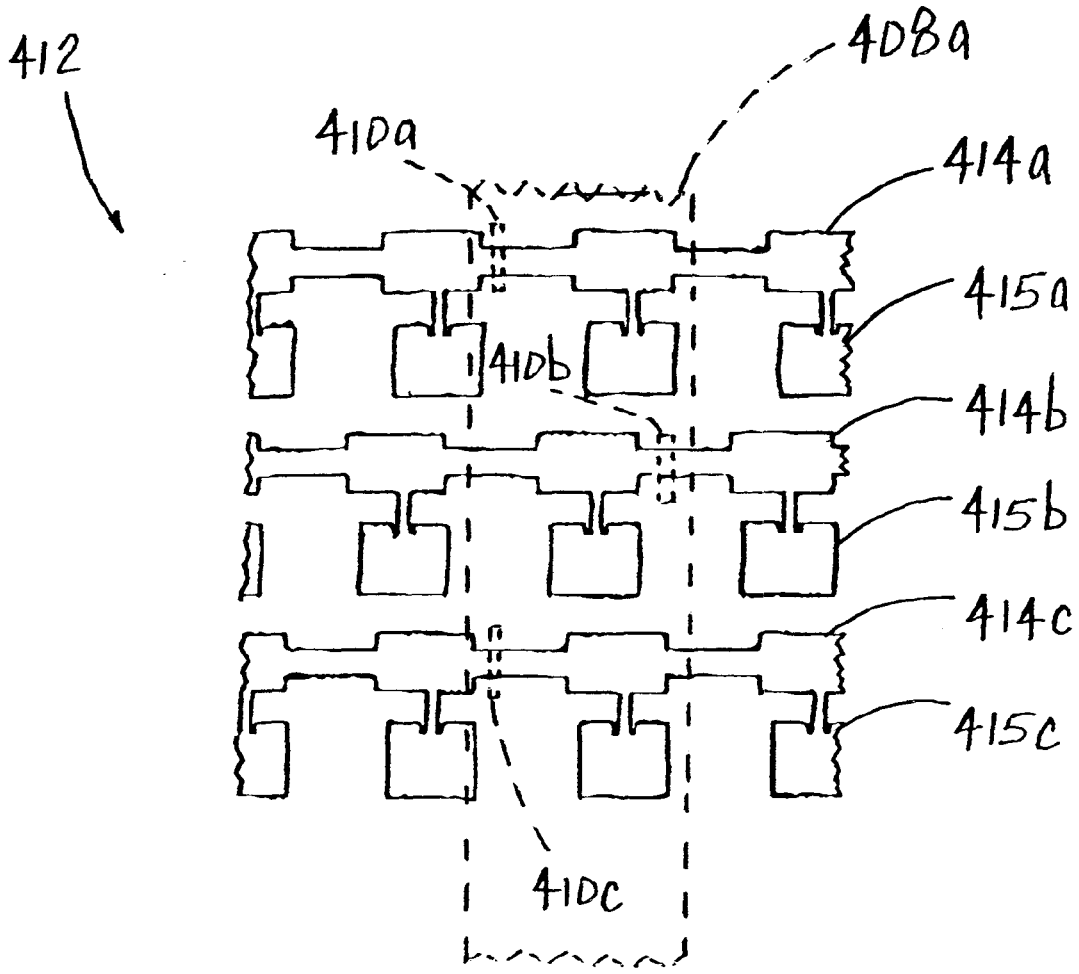
*Fig. 4 - Prior Art*

REDUCTION OF THE EFFECTS OF PROCESS MISALIGNMENT IN MILLIMETER WAVE ANTENNAS

CROSS REFERENCE TO RELATED APPLICATIONS

N/A

STATEMENT REGARDING FEDERALLY SPONSORED RESEARCH OR DEVELOPMENT

N/A

BACKGROUND OF THE INVENTION

The present invention relates generally to millimeter wave radar, and more specifically to a millimeter wave radar system configured to reduce adverse effects of process misalignment.

In recent years, millimeter wave radar has been increasingly employed in automotive vehicles as part of Adaptive Cruise Control (ACC) systems. A conventional millimeter wave radar system adapted for ACC applications includes an antenna assembly such as a microstrip antenna array assembly that can be mounted on an automotive vehicle. The microstrip antenna array assembly is configured to transmit one or more directional beams to scan a field of view ahead of the vehicle, and receive one or more electromagnetic waves reflected from objects within the field of view to collect certain information about the objects. For example, the collected information may include data on the relative speed, direction, and/or distance of the objects in a roadway ahead of the vehicle. Further, the ACC system may use that information to decide whether to alert a driver of the vehicle to a particular obstacle in the roadway and/or automatically change the speed of the vehicle to prevent a collision with the obstacle.

The microstrip antenna array assembly included in the conventional millimeter wave radar system comprises a channel formed in a surface of a backing plate, and a microstrip antenna array assembly including a microstrip antenna array and a ground plane with a dielectric substrate disposed therebetween. The channel formed in the backing plate surface and the adjacent ground plane form a waveguide. The ground plane has a plurality of slots formed therethrough such that junctions of the waveguide, the slots, and the microstrip antenna array define a plurality of respective waveguide-slot-microstrip transitions. The conventional millimeter wave radar system further includes a transmitter/receiver unit configured to transmit electromagnetic wave energy to the waveguide for subsequent transfer to the microstrip antenna array via the waveguide-slot-microstrip transitions, and receive electromagnetic wave energy from the waveguide via the microstrip antenna array and the waveguide-slot-microstrip transitions.

One drawback of the conventional millimeter wave radar system is that it has close manufacturing tolerances, which can lead to misalignment between the channel forming the base of the waveguide and the slots in the ground plane. Such misalignment can cause increased sidelobe levels in radiation fields produced by the millimeter wave radar system. This is particularly problematic in ACC systems because increased sidelobe levels can reduce the sensitivity of the system, and therefore compromise the validity of information collected on objects in a roadway ahead of a vehicle. As a result, the ACC system may make improper decisions regarding whether to alert a driver of the vehicle and/or automatically change the speed of the vehicle to prevent a collision with an obstacle in the roadway.

It would therefore be desirable to have a millimeter wave radar system that can be employed in automotive ACC applications. Such a millimeter wave radar system would be configured to reduce the adverse effects of misalignment in the process for manufacturing the system.

BRIEF SUMMARY OF THE INVENTION

In accordance with the present invention, a millimeter wave radar system that is less sensitive to process misalignment is disclosed. Benefits of the presently disclosed system are achieved by placing slot radiators in a ground plane disposed between a microstrip antenna array and a waveguide channel so that the slots are on the same side of the longitudinal centerline of a waveguide wall.

In one embodiment, the millimeter wave radar system includes at least one channel formed in a metal backing plate and an adjacent microstrip antenna array assembly. The microstrip antenna array assembly includes a substantially planar circuit board, a single microstrip antenna array disposed on a first surface of the circuit board, and a ground plane disposed along a second circuit board surface such that a dielectric substrate of the circuit board is between the microstrip antenna array and the ground plane. The combination of the microstrip antenna array, the dielectric substrate, and the ground plane forms a plurality of microstrip transmission lines.

The ground plane is mounted to the metal backing plate comprising the at least one channel to form at least one waveguide. A portion of the ground plane comprising a wall of the waveguide has a plurality of slots formed therethrough. The plurality of slots is transversely located relative to the microstrip transmission lines and longitudinally located relative to the waveguide, thereby forming a corresponding plurality of waveguide-slot-microstrip transitions for transferring electromagnetic wave energy between the microstrip transmission lines and the waveguide.

The plurality of slots is placed on the same side of the longitudinal centerline of the waveguide wall. In a preferred embodiment, the plurality of slots comprises collinear slots having spacing equal to about one wavelength at the operating frequency of the system to assure that the electromagnetic wave energies transferred via the waveguide-slot-microstrip transitions are inphase.

In another embodiment, the plurality of collinear slots has spacing equal to less than one wavelength at the operating frequency of the system. Conductive microstrips included in the microstrip antenna array are configured to provide sufficient phase shift to assure that the electromagnetic wave energies transferred to the microstrip antenna array are in-phase.

By placing the plurality of slots on the same side of the longitudinal centerline of the waveguide wall, manufacturing tolerances of the millimeter wave radar system are relaxed, thereby reducing adverse affects of process misalignment, e.g., increased sidelobe levels in radiation fields.

Other features, functions, and aspects of the invention will be evident from the Detailed Description of the Invention that follows.

BRIEF DESCRIPTION OF THE SEVERAL VIEWS OF THE DRAWING

The invention will be more fully understood with reference to the following Detailed Description of the Invention in conjunction with the drawings of which:

FIG. 4 is a detailed view of a microstrip antenna array included in a conventional millimeter wave radar system.

DETAILED DESCRIPTION OF THE INVENTION

A millimeter wave radar system that can be employed in automotive Adaptive Cruise Control (ACC) applications is disclosed. The millimeter wave radar system includes a microstrip antenna array assembly, at least one waveguide, and a plurality of waveguide-to-microstrip transmission line transitions disposed on the same side of the longitudinal centerline of a waveguide wall, thereby reducing manufacturing tolerances and adverse effects of process misalignment.

FIG. 4 depicts a detailed view of a microstrip antenna array 412 included in a conventional millimeter wave radar system. The microstrip antenna array 412 includes a plurality of conductive microstrips 414*a*, 414*b*, and 414*c*. The conductive microstrips 414*a*, 414*b*, and 414*c* have respective pluralities of radiating antenna elements coupled thereto, e.g., square antenna elements 415*a*, 415*b*, and 415*c*.

FIG. 4 further depicts, in phantom, a waveguide comprising a base channel 408*a* formed in a metal backing plate (not shown) and a waveguide wall formed by a ground plane disposed between the metal backing plate and the microstrip antenna array 412. The waveguide wall has a plurality of slots 410*a*, 410*b*, and 410*c* (also shown in phantom) formed therethrough and placed in a staggered arrangement along the periphery of the waveguide wall. The plurality of slots 410*a*, 410*b*, and 410*c* is transversely located relative to the respective conductive microstrips 414*a*, 414*b*, and 414*c* and longitudinally located relative to the waveguide channel 408a, thereby forming a corresponding plurality of waveguide-slot-microstrip transitions. Each of the waveguide-slot-microstrip transitions is configured to transfer electromagnetic wave energy between respective microstrip transmission lines comprising the conductive microstrips 414*a*, 414*b*, and 414*c* and the waveguide.

It is noted that placing the plurality of slots 410*a*, 410*b*, and 410*c* in a staggered arrangement along the periphery of the waveguide wall tightens manufacturing tolerances in the conventional millimeter wave radar system, thereby increasing the chance of misalignment between the channel 408*a* forming the base of the waveguide and the slots 410*a*, 410*b*, and 410*c* in the waveguide wall. Such misalignment can increase sidelobe levels in radiation fields produced by the conventional millimeter wave radar system and degrade the performance of the overall system.

Figure 1:
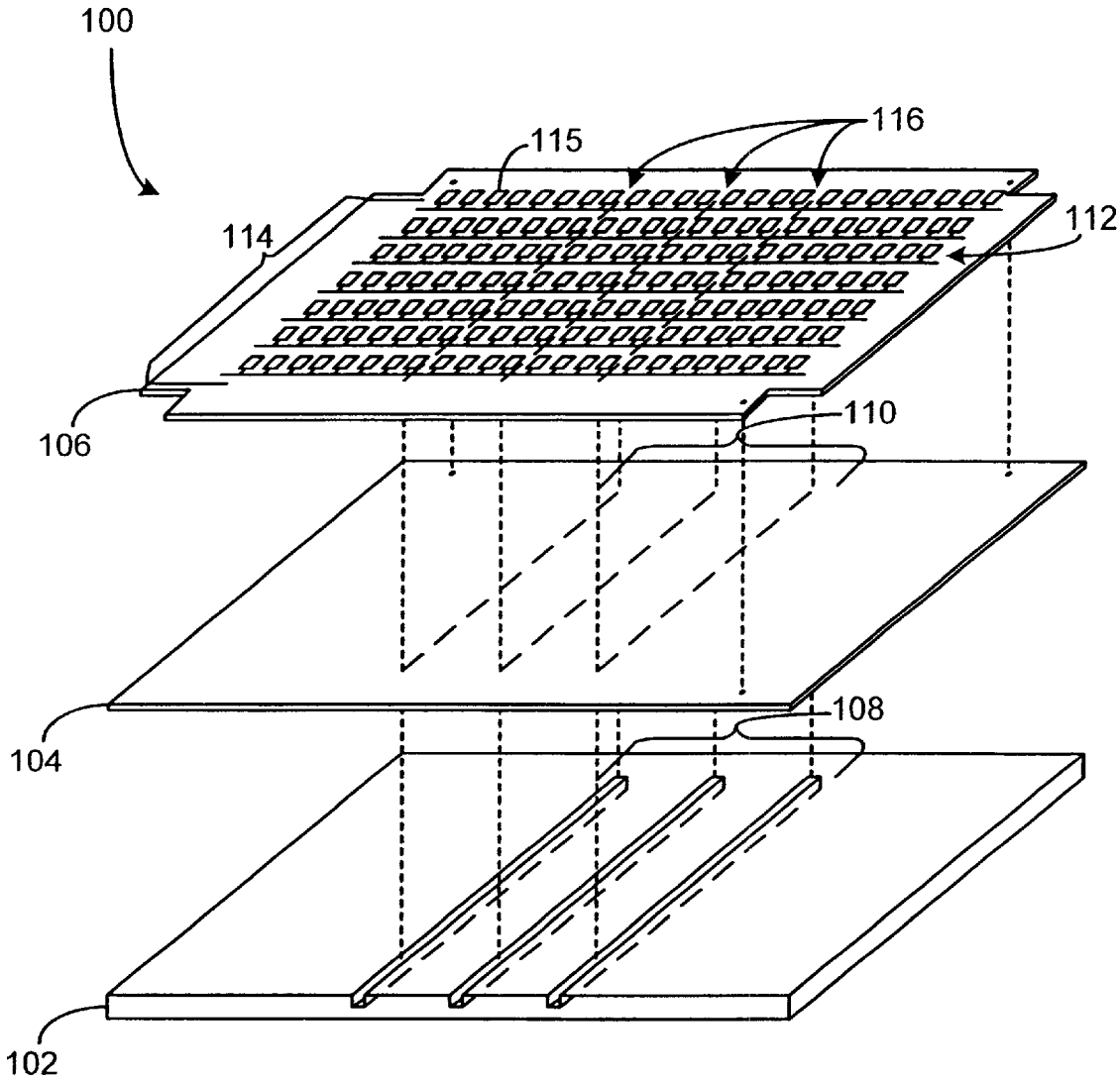
FIG. 1 is an exploded view of a millimeter wave radar system including a plurality of channels formed in a metal backing plate and an adjacent microstrip antenna array assembly according to the present invention.

FIG. 1 depicts an illustrative embodiment of a millimeter wave radar system 100 in accordance with the present invention. The millimeter wave radar system 100 includes a plurality of channels 108 formed in a metal backing plate 102; and, a microstrip antenna array assembly comprising a single microstrip antenna array 112 (also known as a patch antenna array) disposed on a surface of a substantially planar circuit board 106, and an adjacent ground plane 104.

The microstrip antenna array 112 includes a plurality of conductive microstrips shown generally at reference numeral 114, and pluralities of radiating antenna elements such as square antenna element 115 coupled to the respective conductive microstrips 114. Each radiating antenna element 115 is coupled to one of the conductive microstrips 114 by a microstrip feed line (not numbered). For example, the microstrip antenna array 112 comprising the conductive microstrips 114 and the square antenna elements 115 may be fabricated on the surface of the circuit board 106 by a conventional photo etching process or any other suitable process.

A dielectric substrate (not numbered) of the circuit board 106 separates the plurality of conductive microstrips 114 from the adjacent ground plane 104 to form a corresponding plurality of microstrip transmission lines. Further, the ground plane 104 is mounted to the metal backing plate 102 comprising the plurality of channels 108 to form a corresponding plurality of waveguides having generally rectangular cross-section. For example, respective opposing surfaces of the ground plane 104 may be bonded to the dielectric substrate of the circuit board 106 and the metal backing plate 102 using an epoxy resin or any other suitable adhesive.

In the illustrated embodiment, the ground plane 104 has a plurality of slots 110 formed therethrough and arranged in three (3) columns, in which each column includes the same number of collinear slots. For example, the plurality of slots 110 may be formed through the ground plane 104 by etching or any other suitable technique.

Accordingly, when the ground plane 104 of the microstrip antenna array assembly is bonded to the metal backing plate 102, the plurality of slots 110 is transversely located relative to the respective conductive microstrips 114 and longitudinally located relative to the respective channels 108, thereby forming a corresponding plurality of waveguide-slot-microstrip transitions. Further, each one of the waveguide-slot-microstrip transitions is configured to transfer electromagnetic wave energy between a respective microstrip transmission line and a respective waveguide.

An exemplary embodiment of a slot-coupled patch antenna array is described in co-pending U.S. patent application Ser. No. 09/691,815 filed Oct. 19, 2000 entitled SLOT FED SWITCH BEAM PATCH ANTENNA, which is incorporated herein by reference. That application describes a waveguide configured to receive respective electromagnetic waves; a plurality of slots in the waveguide through which the respective waves are fed; and, a patch antenna array comprising a plurality of microstrip transmission lines configured to receive the waves, produce phase differences in the waves, and transmit corresponding directional beams at predetermined angles via radiating antenna elements. In a similar manner, the three (3) waveguides of the millimeter wave radar system 100 (see FIG. 1) are configured to receive respective electromagnetic waves, and the plurality of waveguide-slot-microstrip transitions comprising the slots 110 is configured to transfer the respective waves to the single microstrip antenna array 112 to produce phase differences in the waves, thereby causing the transmission of three (3) directional beams by the radiating antenna elements 115.

Figure 2A:
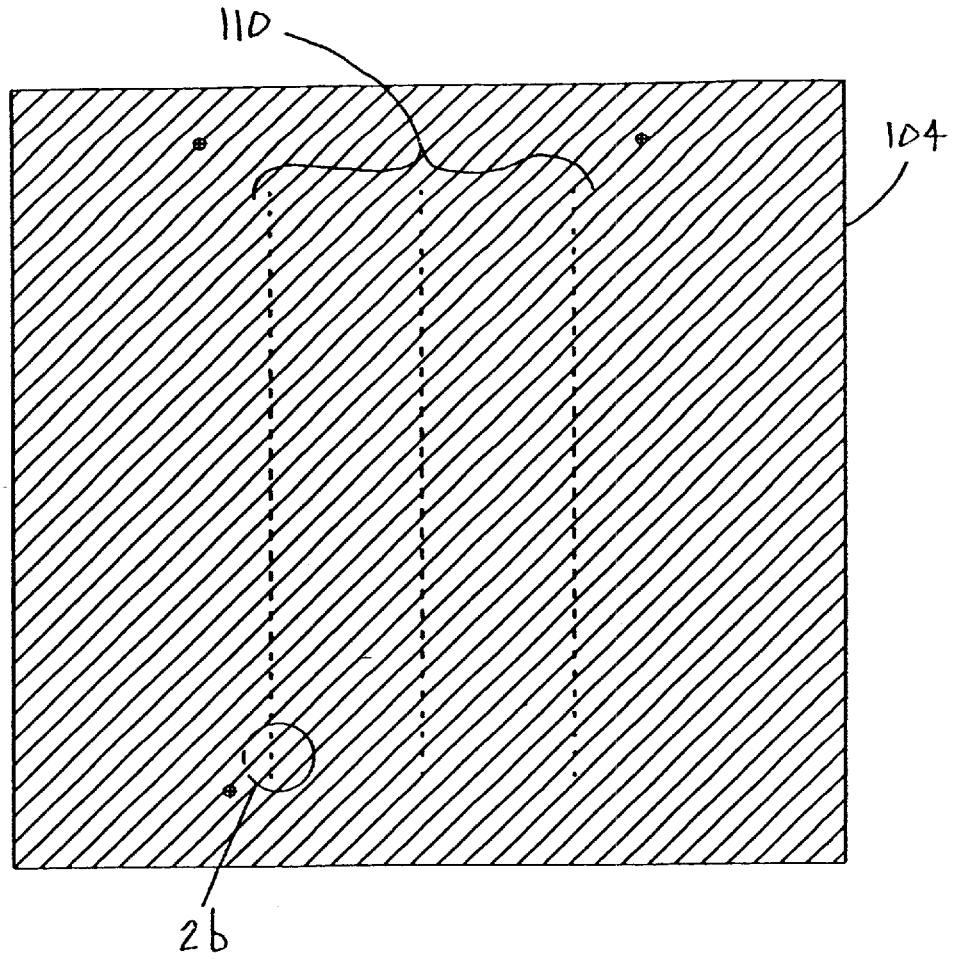
FIG. 2*a* is a bottom plan view of a ground plane included in the microstrip antenna array assembly illustrated in FIG. 1.
Figure 2B:
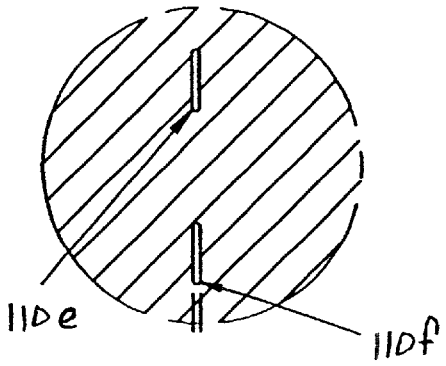
FIG. 2*b* is a detailed view of the ground plane illustrated in FIG. 2*a*.

FIG. 2*a* depicts a bottom plan view of the ground plane 104 included in the millimeter wave radar system 100 (see FIG. 1). In the illustrated embodiment, the plurality of slots 110 is formed through the ground plane 104 in three (3) columns, in which each column comprises thirty (30) collinear slots 110. It is noted that the ground plane 104 and the microstrip antenna array 112 (see FIG. 1) are arranged in the microstrip antenna array assembly so that one (1) slot 110 from each column feeds an electromagnetic wave to a respective microstrip transmission line. FIG. 2*b* depicts a detailed view of the ground plane 104 including illustrative embodiments of slots 110*e* and 10*f*.

Figure 3A:
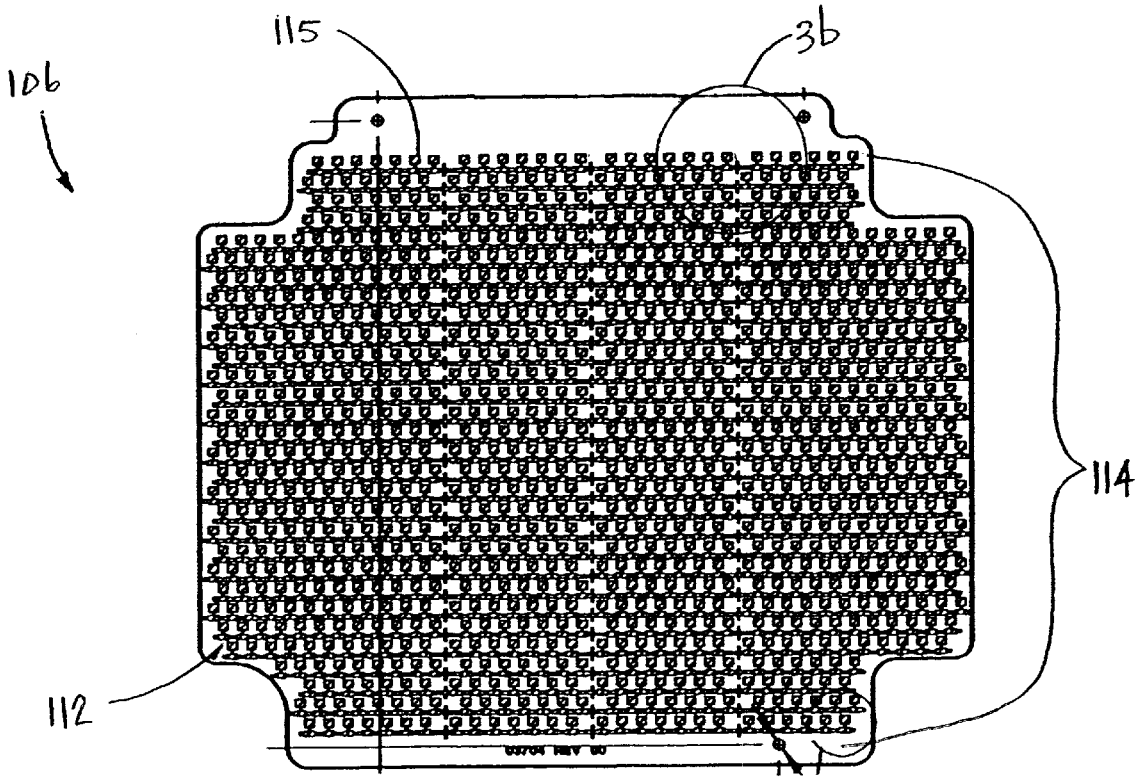
FIG. 3*a* is a top plan view of a microstrip antenna array included in the microstrip antenna array assembly illustrated in FIG. 1.

FIG. 3*a* depicts a top plan view of the circuit board 106 included in the millimeter wave radar system 100 (see FIG. 1), in which a preferred embodiment of the microstrip antenna array 112 is shown. In the illustrated embodiment, the microstrip antenna array 112 includes thirty (30) parallel conductive microstrips 114.

As described above, one (1) slot 110 from each of the three (3) columns of slots 110 feeds an electromagnetic wave from a waveguide to a respective microstrip transmission line of the microstrip antenna array assembly. As a result, phase differences are produced in the waves, which accumulate to cause the antenna elements 115 to transmit three (3) directional beams at predetermined angles.

Figure 3B:
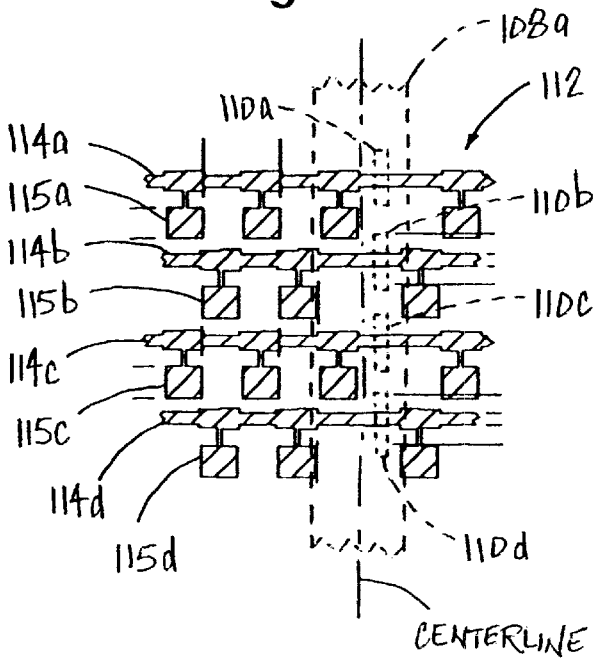
FIG. 3*b* is a detailed view of the microstrip antenna array illustrated in FIG. 3*a*.

FIG. 3*b* depicts a detailed view of the microstrip antenna array 112 including illustrative embodiments of conductive microstrips 114*a*, 114*b*, 114*c*, and 114*d*. The conductive microstrips 114*a*, 114*b*, 114*c*, and 114*d* have respective pluralities of antenna elements coupled thereto, e.g., antenna elements 115*a*, 115*b*, 115*c*, and 115*d*.

FIG. 3*b* further depicts, in phantom, a waveguide comprising a base channel 108*a* formed in the metal backing plate 102 (see FIG. 1) and a waveguide wall (not numbered) formed by the ground plane 104 (see FIG. 1). The waveguide wall has a plurality of slots 110*a*, 10*b*, 110*c*, and 110*d* (also shown in phantom) formed therethrough and placed on the same side of the longitudinal centerline of the waveguide wall. In the illustrated embodiment, the plurality of slots 110*a*, 110*b*, 110*c*, and 110*d* comprises collinear slots.

Those of ordinary skill in the art will appreciate that a desired transfer of electromagnetic wave energy between a waveguide and a microstrip transmission line can be achieved by forming slots through an adjacent wall of the waveguide so that the slots are offset from the longitudinal centerline of the wall. As a result, longitudinal magnetic field components of the electromagnetic wave energy appear at the slots, which allow the desired transfer of the electromagnetic wave energy.

It is noted that in alternative embodiments, the slots 110*a*, 110*b*, 110*c*, and 110*d* may be placed in a staggered arrangement on the same side of the centerline of the waveguide wall. Further, the narrow slots 110*a*, 110*b*, 110*c*, and 110*d* may alternate between longitudinal and transverse placement relative to the waveguide channel on the same side of the waveguide wall.

To assure that the electromagnetic wave energies transferred from the waveguides to the microstrip transmission lines via the slots 110 are in-phase, the collinear slots 110*a*, 110*b*, 110*c*, and 110*d* may be placed in the waveguide wall with a spacing equal to about one wavelength at the operating frequency of the system, which is preferably about 77 GHz. In a preferred embodiment, the length of the slots 110 is less than one half of a wavelength at the operating frequency of 77 GHz, and the slot width is narrow relative to the wavelength.

Because increased spacings between the slots 110 can increase sidelobe levels in radiation fields produced by the millimeter wave radar system 100 (see FIG. 1), the spacing between the collinear slots 110*a*, 10*b*, 110*c*, and 110*d* may be reduced to a value that is less than one wavelength, e.g., one-half wavelength. To assure that the electromagnetic wave energies transferred from the waveguide to the microstrip transmission lines via the closely spaced slots 110 continue to be in-phase, the conductive microstrips 114 (see FIG. 3*a*) of the microstrip antenna array 112 may be employed as respective microstrip phase shifters.

Those of ordinary skill in the art will further appreciate that electromagnetic wave energy propagating along a microstrip transmission line undergoes a phase shift proportional to the length of the transmission line. Accordingly, a microstrip transmission line having a predetermined length can be configured as a microstrip phase shifter to provide a desired phase shift.

By setting the microstrip transmission lines comprising the conductive microstrips 144 to predetermined lengths, the electromagnetic wave energies propagating along the respective microstrip transmission lines can be brought in-phase, even if the slots 100 used to transfer the electromagnetic wave energies from the waveguide to the microstrip transmission lines are spaced less than one wavelength apart.

It is noted that the millimeter wave radar system 100 of FIG. 1 can be used to implement ACC systems in automotive vehicles. For example, the millimeter wave radar system 100 may be mounted on an automotive vehicle (not shown), and the microstrip antenna array 112 may be configured to transmit directional beams to scan a field of view in a roadway ahead of the vehicle and collect information about objects within the field of view. The collected information may include data on the speed, direction, and/or distance of the objects in the roadway relative to the vehicle. The ACC system may subsequently use that information to decide, e.g., whether to alert a driver of the vehicle to a particular obstacle in the roadway and/or automatically change the speed of the vehicle to prevent a collision with the obstacle.

By placing pluralities of collinear slots 110 on the same side of longitudinal centerlines of respective walls corresponding to the waveguide channels 108, manufacturing tolerances of the millimeter wave radar system 100 are relaxed, thereby reducing adverse affects of process misalignment such as unacceptable sidelobe levels in directional beams transmitted by ACC systems. This makes it easier to implement a multi-beam automotive antenna using the single microstrip antenna array 112. For example, the microstrip antenna array assembly including the single microstrip antenna array 112 and the ground plane 104 comprising the three (3) columns of collinear slots 110 (see FIG. 1) may be used to implement a three-beam automotive antenna.

It should be noted that the geometrical shape of the radiating antenna elements 115 may take different forms. Further, the electrical parameters of the dielectric substrate, the dimensions of the conductive microstrips 114, the dimensions of the microstrip feed lines, the dimensions of the radiating antenna elements 115, and the size and position of the slots 110 may be modified for further enhancing the performance of the system.

It will be appreciated by those of ordinary skill in the art that modifications to and variations of the above-described system may be made without departing from the inventive concepts disclosed herein. Accordingly, the invention should not be viewed as limited except as by the scope and spirit of the appended claims.

What is claimed is:

1. A millimeter wave radar system, comprising:

a microstrip antenna array assembly comprising a plurality of conductive microstrips, a ground plane, and a dielectric substrate disposed between the plurality of conductive microstrips and the ground plane to form a corresponding plurality of microstrip transmission lines; and a metal plate having at least one channel formed in a surface thereof, the metal plate surface being coupled to the ground plane to form at least one waveguide, the ground plane forming a wall of the waveguide, wherein the waveguide wall includes a plurality of apertures forming a corresponding plurality of waveguide-to-microstrip transmission line transitions, the plurality of apertures being disposed along at least one line and offset to the same side of a longitudinal centerline of the waveguide wall so as to reduce effects of process misalignment.

2. The system of claim 1 wherein at least one of the plurality of microstrip transmission lines has a predetermined length to assure that electromagnetic wave energies transferred between the at least one waveguide and the microstrip transmission lines via the plurality of waveguide-to-microstrip transmission line transitions are in-phase.

3. The system of claim 1 wherein the microstrip antenna array assembly further includes a plurality of radiating elements coupled to each conductive microstrip.

4. The system of claim 1 wherein the apertures are longitudinally located relative to the waveguide and transversely located relative to the respective microstrip transmission lines.

5. The system of claim 1 wherein the plurality of apertures comprises a plurality of collinear slots.

6. The system of claim 5 wherein the plurality of collinear slots is arranged in a plurality of columns.

7. A millimeter wave radar system, comprising:

a microstrip antenna array assembly configured to transmit and receive a plurality of directional beams, the assembly including a single microstrip antenna array, a ground plane, and a dielectric substrate disposed between the single microstrip antenna array and the ground plane;

a metal plate having a plurality of channels formed in a surface thereof, the metal plate surface being coupled to the ground plane to form a plurality of waveguides, the ground plane forming walls of the respective waveguides; and pluralities of transitions disposed between the single microstrip antenna array and the respective waveguides, the pluralities of transitions being configured to transfer electromagnetic wave energies between the microstrip antenna array and the respective waveguides, wherein the pluralities of transitions are disposed along respective lines and offset to the same sides of longitudinal centerlines of the respective waveguide walls so as to reduce effects of process misalignment.

8. The system of claim 7 wherein the pluralities of transitions comprise pluralities of slots formed through the ground plane.

9. The system of claim 8 wherein the pluralities of slots comprise pluralities of collinear slots arranged in respective columns.

10. The system of claim 9 wherein the microstrip antenna array assembly is configured to transmit a number of directional beams equal to the number of respective columns of slots.

11. A method of operating a millimeter wave radar system, comprising the steps of:

providing a plurality of first electromagnetic waves to a corresponding plurality of waveguides;

transferring the plurality of first electromagnetic waves from the corresponding plurality of waveguides to a single microstrip antenna array by respective pluralities of waveguide-to-microstrip transmission line transitions disposed along respective lines and offset to the same sides of longitudinal centerlines of respective waveguide walls; and transmitting a plurality of directional beams corresponding to the plurality of electromagnetic waves by the single microstrip antenna array.

12. The method of claim 11 further including the steps of receiving at least one second electromagnetic wave by the single microstrip antenna array, and transferring the at least one second electromagnetic wave from the single microstrip antenna array to the plurality of waveguides by the pluralities of offset waveguide-to-microstrip transmission line transitions.

13. The method of claim 11 further including the step of phase shifting at least one of the plurality of first electromagnetic waves by a corresponding microwave transmission line to assure that the plurality of first electromagnetic waves transferred from the corresponding waveguides to the microstrip antenna array via the plurality of waveguide-to-microstrip transmission line transitions are in-phase.

* * * * *